United States Patent [19]

Dickakian

[11] 4,271,006

[45] Jun. 2, 1981

[54] PROCESS FOR PRODUCTION OF CARBON ARTIFACT PRECURSOR

[75] Inventor: Ghazi Dickakian, Scotch Plains, N.J.

[73] Assignee: Exxon Research and Engineering Company, Florham Park, N.J.

[21] Appl. No.: 143,136

[22] Filed: Apr. 23, 1980

[51] Int. Cl.[3] ..... C10C 1/20; C10C 1/18

[52] U.S. Cl. ..... 208/40; 208/8 R; 208/41; 208/44; 208/45

[58] Field of Search ..... 208/40, 45, 8, 44

[56] References Cited

U.S. PATENT DOCUMENTS

| | | | |
|---|---|---|---|
| 2,992,181 | 7/1961 | Renner | 208/40 |
| 3,140,248 | 7/1964 | Bell et al. | 208/40 |
| 3,238,116 | 3/1966 | Hamner et al. | 208/6 |
| 3,725,240 | 4/1973 | Baum | 208/76 |
| 4,086,156 | 4/1978 | Dickakian | 208/44 |
| 4,184,942 | 1/1980 | Angier et al. | 208/45 |
| 4,207,117 | 6/1980 | Espenscheid | 208/45 |
| 4,208,267 | 6/1980 | Diefendorf et al. | 208/45 |

FOREIGN PATENT DOCUMENTS

| | | | |
|---|---|---|---|
| 1210118 | 2/1966 | Fed. Rep. of Germany | 208/44 |
| 2555812 | 6/1976 | Fed. Rep. of Germany | 208/44 |

*Primary Examiner*—Veronica O'Keefe

*Attorney, Agent, or Firm*—Joseph J. Dvorak

[57] ABSTRACT

A process for converting cat cracker bottoms to a feedstock suitable for carbon artifact manufacture, especially carbon fiber manufacture, is provided. Basically, the cat cracker bottom is stripped of fractions boiling below about 400° C., heat soaked and then vacuum stripped to provide a suitable feedstock.

9 Claims, No Drawings

PROCESS FOR PRODUCTION OF CARBON ARTIFACT PRECURSOR

FIELD OF THE INVENTION

This invention is concerned generally with the preparation of a feedstock for carbon artifact manufacture from cat cracker residues.

BACKGROUND OF THE INVENTION

As is well known, the catalytic conversion of virgin gas oils containing aromatic, naphthenic and paraffinic molecules results in the formation of a variety of distillates that have ever-increasing utility and importance in the petrochemical industry. The economic and utilitarian value, however, of the residual fraction of the cat cracking processes has not increased to the same extent as the light overhead fractions has. One potential use for such cat cracker bottoms is in the manufacture of carbon artifacts. As is well known, carbon artifacts have been made by pyrolyzing a wide variety of organic materials. Indeed, one carbon artifact of particularly important commercial interest today is carbon fiber. Hence, particular reference is made herein to carbon fiber technology. Nevertheless, it should be appreciated that this invention has applicability to carbon artifact formation generally and, most particularly, to the production of shaped carbon articles in the form of filaments, yarns, films, ribbons, sheets, and the like.

Referring now in particular to carbon fibers, suffice it to say that the use of carbon fibers in reinforcing plastic and metal matrices has gained considerable commercial acceptance where the exceptional properties of the reinforcing composite materials, such as their higher strength to weight ratio, clearly offset the generally higher costs associated with preparing them. It is generally accepted that large scale use of carbon fibers as a reinforcing material would gain even greater acceptance in the marketplace if the costs associated with the formation of the fibers could be substantially reduced. Thus, the formation of carbon fibers from relatively inexpensive carbonaceous pitches has received considerable attention in recent years.

Many carbonaceous pitches are known to be converted at the early stages of carbonization to a structurally ordered optically anisotropic spherical liquid crystal called mesophase. The presence of this ordered structure prior to carbonization is considered to be a significant determinant of the fundamental properties of any carbon artifact made from such a carbonaceous pitch. Indeed, the ability to generate high optical anisotropicity during processing is accepted, particularly in carbon fiber production, as a prerequisite to the formation of high quality products. Thus, one of the first requirements of a feedstock material suitable for carbon artifact manufacture, and particularly carbon fiber production, is its ability to be converted to a highly optically anisotropic material.

In addition to being able to develop a highly ordered structure, suitable feedstocks for carbon artifact manufacture, and in particular carbon fiber manufacture, should have relatively low softening points rendering them suitable for being deformed and shaped into desirable articles. Thus, in carbon fiber manufacture, a suitable pitch which is capable of generating the requisite highly ordered structure also must exhibit sufficient viscosity for spinning. Unfortunately, many carbonaceous pitches have relatively high softening points.

Indeed, incipient coking frequently occurs in such materials at temperatures where they have sufficient viscosity for spinning. The presence of coke, however, or other infusible materials and/or undesirably high softening point components generated prior to or at the spinning temperatures are detrimental to processability and are believed to be detrimental to product quality. Thus, for example, U.S. Pat. No. 3,919,376 discloses the difficulty in deforming pitches which undergo coking and/or polymerization at the softening temperature of the pitch.

Another important characteristic of the feedstock for carbon artifact manufacture is its rate of conversion to a suitable optically anisotropic material. For example, in the above-mentioned U.S. patent, it is disclosed that 350° C. is the minimum temperature generally required to produce mesophase from a carbonaceous pitch. More importantly, however, is the fact that at least one week of heating is necessary to produce a mesophase content of about 40% at that minimum temperature. Mesophase, of course, can be generated in shorter times by heating at higher temperatures. However, as indicated above, at temperatures in excess of about 425° C., incipient coking and other undesirable side reactions do take place which can be detrimental to the ultimate product quality.

In copending application Ser. No. 903,172, filed May 5, 1978, now U.S. Pat. No. 4,208,267 it has been disclosed that typical graphitizable carbonaceous pitches contain a separable fraction which possesses very important physical and chemical properties insofar as carbon fiber processing is concerned. Indeed, the separable fraction of typical graphitizable carbonaceous pitches exhibits a softening range and viscosity suitable for spinning and has the ability to be converted rapidly at temperatures in the range generally of about 230° C. to about 400° C. to an optically anisotropic deformable pitch containing greater that 75% of a liquid crystalline type structure. Unfortunately, the amount of separable fraction present in well known commercially available petroleum pitches, such as Ashland 240 and Ashland 260, to mention a few, is exceedingly low. For example, with Ashland 240, no more than about 10% of the pitch constitutes a separable fraction capable of being thermally converted to a deformable anisotropic phase.

In U.S. Pat. No. 4,184,942, it has been disclosed that the amount of that fraction of typical graphitizable carbonaceous pitches that exhibits a softening point and viscosity which is suitable for spinning and which has the ability to be rapidly converted at low temperatures to highly optically anisotropic deformable pitch can be increased by heat soaking the pitch, for example at temperatures in the range of 350° C. to 450° C., until spherules visible under polarized light begin to appear in the pitch. The heat soaking of such pitch results in an increase in the amount of the fraction of the pitch capable of being converted to an optically anisotropic phase.

In copending application Ser. No. 48,507, filed June 14, 1979, now U.S. Pat. No. 4,219,404 it has been disclosed that the polycondensed aromatic oils present in isotropic graphitizable pitches are generally deterimental to the rate of formation of highly optically anisotropic material in such feedstocks when they are heated at elevated temperatures and that, in preparing a feedstock for carbon artifact manufacture, it is particularly advantageous to remove at least a portion of the polycondensed aromatic oils normally present in the pitch simultaneously with, or prior to, heat soaking of the pitch for converting it into a feedstock suitable in carbon artifact manufacture.

SUMMARY OF THE INVENTION

It has now been discovered that the residual material from catalytic cracking processes, for example cat cracker bottoms boiling in the range of about 200° C. to 550° C., can be readily converted to a feedstock suitable for carbon artifact manufacture by first stripping the cat cracker bottom at atmospheric or reduced pressure to remove those fractions present in the cat cracker bottom which boil below about 400° C. and, thereafter, heat soaking the so-treated cat cracker bottom to provide a carbonaceous pitch which, after at least a portion of the aromatic oils present in the pitch has been removed, is suitable for carbon artifact manufacture.

Full appreciation of all the ramifications of the present invention will be more readily understood upon a reading of the detailed description which follows.

DETAILED DESCRIPTION OF THE INVENTION

The term catalytic cracking refers to a thermal and catalytic conversion of gas oils, particularly virgin gas oils, boiling generally between about 316° C. and 566° C., into lighter, more valuable products.

Cat cracker bottom refers to that fraction of the product of the cat cracking process which boils in the range from about 200° C. to 550° C.

Heat soaking is the exposure of a cat cracker bottom to elevated temperatures, e.g., 390° C. to 450° C., for a relatively long period of time to increase the aromaticity and the amount of compounds that are insoluble in toluene.

Cat cracker bottoms typically have relatively low aromaticity insofar as when compared with graphitizable isotropic carbonaceous pitches suitable in carbon artifact manufacture.

Specifications for a typical cat cracker bottom that is suitable in the present invention are given in Table I.

TABLE I

| | Range |
|---|---|
| Physical Characteristics | |
| Viscosity cst at 210° F. | 1.0–10.0 |
| Ash content, wt. % | 0.010–2.0 |
| Coking value (wt. % at 550° C.) | 6.0–18.0 |
| Asphaltene (n-heptane insoluble), % | 0.1–12.0 |
| Toluene insolubles (0.35μ), % | 0.010–1.0 |
| Number average mol. wt. | 220–290 |
| Elemental Analysis | |
| Carbon, % | 88.0–90.32 |
| Hydrogen, % | 7.74–7.40 |
| Oxygen, % | 0.10–0.30 |
| Sulfur, % | 1.0–4.5 |
| Chemical Analysis (proton NMR) | |
| Aromatic carbon (atom %) | 54–64 |
| Carbon/hydrogen atomic ratio | 0.90–1.0 |
| Asphaltene Analysis | |
| Number average mol. wt. | 550–700 |
| Coking value, wt. % at 550° C. | 55–65 |
| Aromatic carbon (atom %) | 55–70 |
| Bureau of Mines Correlation Index | 120–140 |

In the process of the present invention, a cat cracker bottom is heated to temperatures generally in the range of about 250° C. to about 380° C. and preferably at 280° C. to 350° C. while maintaining the so-heated cat cracker bottom under reduced pressures, for example between 5 to about 75 millimeters mercury, thereby effectively vacuum stripping the pitch.

In an alternate embodiment of the present invention, the cat cracker bottom is treated with steam at temperatures generally in the range of 300° C. to 380° C., thereby effectively removing those fractions present in the pitch boiling below about 400° C.

In either the case of vacuum stripping or steam stripping, the process is continued until at least a part of the low boiling fractions present in the cat cracker bottom are removed. Indeed, it is preferred to remove substantially all the low boiling fractions present. Thus, from about 10% to about 90% of the low boiling fractions of the cat cracker bottom are generally removed in accordance with the process of this invention.

After removing the low boiling fractions, i.e., those fractions boiling generally below about 400° C., the so-treated cat cracker bottom is heat soaked. Optionally and preferably heat soaking is conducted at temperatures in the range of about 390° C. to about 450° C. and preferably at 410° C. to 420° C. for times ranging from about ½ hour to 10 hours and preferably for about 2 to 5 hours. In the practice of the present invention, it is particularly preferred that heat soaking be done in an inert atmosphere such as nitrogen or alternatively in a hydrogen atmosphere. Optionally heat soaking may be conducted at reduced pressures.

After heat soaking the pitch, the pitch can be used directly in carbon artifact manufacture. Optionally and preferably, however, the heat-soaked pitch is then heated in vacuum at temperatures generally below about 400° C. and typically in the range of 320° C. to 380° C. at pressures below atmospheric pressure, generally in the range of about 1.0 to 100 millimeters mercury, to remove at least a portion of the oil present in the pitch. Typically from about 30% to about 50% of the oil present in the pitch is removed.

As will be readily appreciated, the severity of the heat soaking conditions outlined above will affect the nature of the pitch produced. The higher the temperature chosen for heat soaking and the longer the time chosen, the greater the amount of high softening point components that will be generated in the pitch. Consequently, the precise conditions selected for carrying out the heat soaking depend, to an extent, on the use to which the pitch is to be put. Thus, where low softening point is a desirable property of the product pitch, less severe heat soaking conditions will be chosen within the parameters outlined above.

In any event, the pitch produced will contain materials insoluble in quinoline at 75° C. The amount of quinoline insoluble may be as low as 0.5% and as high as 60%, for example. This quinoline insoluble material may consist of coke, ash, catalyst fines, and it also may include high softening point materials generated during heat soaking. In carbon fiber manufacture, these high softening point materials are detrimental to processability of the pitch into fibers. Consequently, when the heat soaked pitch is to be used in carbon fiber production, it is important to remove the undesirable high softening point components present in the pitch. A particularly preferred technique for removing these components is disclosed in copending application Ser. No. 29,760, filed Apr. 13, 1979, which application is incorporated herein by reference. Basically, the heat soaked pitch is fluxed, i.e., it is treated with an organic liquid in the range, for example, of from about 0.5 parts by weight of organic liquid per weight of pitch to about 3 parts by weight of fluxing liquid per weight of pitch, thereby providing a fluid pitch having substantially all the quinoline insoluble material suspended in the fluid in the form of a readily separable solid. The suspended solid is then separated by filtration or the like, and the fluid pitch is then treated with an antisolvent compound so as to precipitate at least a substantial portion of the pitch free of quinoline insoluble solids.

The fluxing compounds suitable in the practice of this invention include tetrahydrofuran, toluene, light aromatic gas oil, heavy aromatic gas oil, tetralin and the like.

As will be appreciated, any solvent system, i.e., a solvent or mixture of solvents which will precipitate and flocculate the fluid pitch, can be employed herein. However, since it is particularly desirable in carbon fiber manufacture to use that fraction of the pitch which is readily convertible into a deformable, optically anisotropic phase such as disclosed in U.S. Ser. No. 903,172, filed May 5, 1978, now U.S. Pat. No. 4,208,267 (incorporated herein by reference), the solvent system disclosed therein is particularly preferred for precipitating the desired pitch fraction. Typically, such solvent or mixture of solvents includes aromatic hydrocarbons such as benzene, toluene, xylene and the like and mixtures of such aromatic hydrocarbons with aliphatic hydrocarbon such as toluene-heptane mixtures. The solvents or mixtures of solvents typically will have a solubility parameter of between 8.0 and 9.5, and preferably between about 8.7 and 9.2 at 25° C. The solubility parameter, $\gamma$, of a solvent or mixture of solvents is given by the expression $$\gamma = \left(\frac{H_v - RT}{V}\right)^{\frac{1}{2}}$$

where $H_v$ is the heat of vaporization of the material;

R is the molar gas constant;

T is the temperature in °K.; and

V is the molar volume.

In this regard, see, for example, J. Hildebrand and R. Scott, "Solubility of Non-Electrolytes", 3rd edition, Reinhold Publishing Company, New York (1949), and "Regular Solutions", Prentice Hall, New Jersey (1962). Solubility parameters at 25° C. for hydrocarbons and commercial $C_6$ to $C_8$ solvents are as follows: benzene, 8.2; toluene, 8.9; xylene, 8.8; n-hexane, 7.3; n-heptane, 7.4; methylcyclohexane, 7.8; bis-cyclohexane, 8.2. Among the foregoing solvents, toluene is preferred. Also, as is well known, solvent mixtures can be prepared to provide a solvent system with the desired solubility parameter. Among mixed solvent systems, a mixture of toluene and heptane is preferred having greater than about 60 volume % toluene, such as 60% toluene/40% heptane and 85% toluene/15% heptane.

The amount of solvent employed will be sufficient to provide a solvent insoluble fraction capable of being thermally converted to greater than 75% of an optically anisotropic material in less than 10 minutes. Typically the ratio of solvent to pitch will be in the range of about 5 millimeters to about 150 millimeters of solvent to a gram of pitch. After heating the solvent, the solvent insoluble fraction can be readily separated by techniques such as sedimentation, centrifugation, filtration and the like. Any of the solvent insoluble fraction of the pitch prepared in accordance with the process of the present invention is eminently suitable for carbon fiber production.

A more complete understanding of the process of this invention can be obtained by reference to the following examples which are illustrative only and are not meant to limit the scope thereof which is fully disclosed in the hereinafter appended claims.

EXAMPLES 1 to 3

In each of the following examples, 1 kilogram of a cat cracker bottom having the following physical inspections was used:

TABLE II

| | |
|---|---|
| Physical Characteristics | |
| Viscosity cst at 210° F. | 9.0 |
| Ash content, wt. % | 0.015 |
| Coking value (wt. % at 550° C.) | 6.9 |
| Asphaltene (n-heptane insolubles), % | 1.0 |
| Toluene insolubles (0.35μ), % | 0.150 |
| Number average mol. wt. | 280 |
| Elemental Analysis | |
| Carbon, % | 89.29 |
| Hydrogen, % | 7.92 |
| Oxygen, % | 0.15 |
| Sulfur, % | 2.90 |
| Chemical Analysis (by proton NMR) | |
| Aromatic carbon (atom %) | 56 |
| Carbon/hydrogen atomic ratio | 0.94 |
| Asphaltene Analysis | |
| Number average mol. wt. | 660 |
| Coking value (at 550° C.), % | 59 |
| Bureau of Mines Correlation Index | 125 |

The cat cracker bottom was charged into a two kilogram glass reactor which was electrically heated and equipped with a mechanical agitator. The charge of cat cracker bottom was pretreated by heating to the temperature and pressure given in Table III and the amount of low boiling fraction removed from the original charge was collected and weighed. This amount also is given in Table III. Thereafter the residue was heat soaked at atmospheric pressure by heating the pretreated cat cracker bottom in a nitrogen atmosphere for the times and temperatures given in the Table. Subsequently, the heat soaked material was cooled and the pressure in the vessel was reduced thereby effectively vacuum stripping the heat soaked pitch of the oil contained therein.

The percent quinoline insolubles in the product pitch was determined by the standard technique of quinoline extraction at 75° C.

In the instances indicated in Table III, the pitch was further treated by refluxing the pitch with an equal part by weight of toluene to render the pitch fluid. The solids suspended in the fluid pitch were removed by filtration. The filtrate was then added to 8 parts by weight of toluene per weight of fluid pitch, and the precipitate was separated, washed with toluene and dried in vacuo at 125° C. for 24 hours.

The optical anisotropicity of the pitch was determined by first heating the pitch of its softening point and then, after cooling, placing a sample of the pitch on a slide with Permount, a histiological mounting medium sold by Fisher Scientific Company, Fairlawn, New Jersey. A slip cover was placed over the slide and, by rotating the cover under hand pressure, the mounted sample was crushed to a powder and evenly dispersed on the slide. Thereafter the crushed sample was viewed under polarized light at a magnification factor of 200× and the percent optical anisotropicity was estimated.

TABLE III

| Example | 1 | 2 | 3 |
|---|---|---|---|
| Pre-Treatment | | | |
| Temperature, °C. | 345 | 340 | 340 |
| Pressure, mm Hg | 75 | 75 | 75 |
| Oil Yield, wt. % | 39.4 | 31.5 | 31.0 |
| Heat Soaking | | | |
| Temperature, °C. | 420 | 430 | 430 |
| Time, hours | 3 | 1 | 2 |
| Vacuum Stripping | | | |
| Pressure, mm Hg | 6.5 | 5.5 | 7.0 |
| Oil Yield, wt. % | 31.0 | 41.9 | 41.3 |
| Pitch Analysis | | | |
| Quinoline Insolubles at 75° C., % | 3.0 | 1.5 | 4.0 |
| Flux Insolubles, % | 7.0 | 6.5 | 18.5 |
| Product Data | | | |
| Toluene Insolubles, % | 20.5 | 18.1 | 16.5 |
| Softening Point of Toluene Insolubles, °C. | 275–300 | 300–325 | 300–325 |
| Optical Activity, % | 75–100 | N.D.* | 75–100 |

*N.D. - Not determined.

What is claimed is:

1. A process for preparing a ptich suitable for carbon artifact manufacture comprising:

providing a cat cracker bottom fraction boiling in the range of from about 200° C. to about 550° C.;

treating said cat cracker bottom fraction to remove at least a portion of said fraction which boils below about 400° C.;

heat soaking the so-treated cat cracker bottom in an inert atmosphere at temperatures in the range of about 390° C. to about 450° C. for times ranging from about ½ to 10 hours to provide a carbonaceous pitch.

2. The process of claim 1 wherein from about 10% to about 90% by weight of said fraction is removed.

3. The process of claim 2 wherein said cat cracker bottom is heated at temperatures in the range of about 250° C. to about 380° C. at pressures of between about 5 millimeters to about 75 millimeters mercury to remove that portion of said bottom fraction which boils below about 400° C.

4. The process of claim 2 wherein said cat cracker bottom is treated with steam at temperatures in the range of about 300° C. to about 380° C. thereby removing the portion of the fraction which boils below about 400° C.

5. The process of claim 1 wherein the inert atmosphere is a hydrogen atmosphere.

6. The process of claim 1 including the step of vacuum stripping said heat soaked pitch at temperatures in the range of about 320° to about 380° C. at pressures in the range of 1 to 100 millimeters of mercury to remove at least a portion of the oils present in said heat soaked pitch.

7. The process of claim 6 wherein from about 30% to about 50% by weight of the oil present in the pitch is removed.

8. A process for preparing a pitch suitable for carbon fiber production comprising:

treating a cat cracker bottom which boils in the range of about 200° C. to about 550° C. to remove about 10% to about 90% by weight of the fractions present in said cat cracker bottom which boil below about 400° C.;

heat soaking the so-treated cat cracker bottom in an inert atmosphere at temperatures in the range of about 390° C. to about 450° C. for time periods ranging from about ½ hour to about 10 hours to provide a carbonaceous pitch;

vacuum stripping said carbonaceous pitch at temperatures in the range of about 320° C. to about 380° C. and at pressures ranging from about 1 to 100 millimeters mercury to removed from about 30% to about 50% by weight of the oil present in said pitch;

adding an organic fluxing liquid to said vacuum stripped pitch to provide a fluid pitch containing insoluble solids suspended therein, said organic fluxing liquid being employed in the range of about 0.5 to 3 parts by weight of liquid per part of pitch;

filtering said pitch to separate said solids;

treating said separated fluid pitch with an organic solvent system having a solubility parameter at 25° C. of between about 8.0 and about 9.5, said treating being at a temperature and with an amount of organic solvent system sufficient to provide a solvent insoluble fraction which is thermally convertible into a deformable pitch containing greater than 75% of an optically anisotropic phase; and separating said solvent insoluble fraction whereby a pitch suitable for carbon fiber production is obtained.

9. The process of claim 8 wherein said organic fluxing liquid is toluene.

* * * * *